United States Patent [19]

Famolare, Jr.

[11] 4,114,297

[45] Sep. 19, 1978

[54] CINCHING CLOSURE

[75] Inventor: Joseph P. Famolare, Jr., Florence, Italy

[73] Assignee: Famolare, Inc., New York, N.Y.

[21] Appl. No.: 791,551

[22] Filed: Apr. 27, 1977

[51] Int. Cl.[2] ..... A43B 11/00

[52] U.S. Cl. ..... 36/50; 36/129

[58] Field of Search ..... 36/50, 129

[56] References Cited

U.S. PATENT DOCUMENTS

| | | | |
|---|---|---|---|
| 384,224 | 6/1888 | Yeagle | 36/50 X |
| 1,328,333 | 1/1920 | Mann | 36/50 |
| 1,763,997 | 6/1930 | Williams | 36/50 X |
| 2,925,672 | 2/1960 | Trovato | 36/50 |
| 3,626,610 | 12/1971 | Dassler | 36/50 |
| 3,703,775 | 11/1972 | Gatti | 36/50 X |

OTHER PUBLICATIONS

Morganton, N.C., News Herald (PNR 7/13/70) clipping "Standard Clothes can be Converted".

*Primary Examiner*—Alfred R. Guest
*Attorney, Agent, or Firm*—Mandeville and Schweitzer

[57] ABSTRACT

A new and improved cinch-type closure is provided for athletic footwear. The closure serves the combined functions of securing the athletic footwear in comfort to the wearer's foot, maintaining the primary shoe fastener, i.e., tied laces, tightly intact, and contributing to the overall support of the wearer's arch. Specifically, the cinch-type closure of the invention utilizes a pair of hooked and looped fastening tapes of the "Velcro" type for locking the cooperative cinching elements, namely, a cinching strap and a mating cinch anchor, and these elements are arranged to form an integral part of the improved athletic footwear.

1 Claim, 3 Drawing Figures

CINCHING CLOSURE

BACKGROUND AND STATEMENT OF THE INVENTION

Conventional shoe laces which become untied or unduly loosened are an annoyance and a hazard to participants in sporting endeavors, as is well known. Furthermore, conventional athletic footwear has soft, lightweight, flexible uppers and often includes reinforced foot support, particularly in the arch. While such support has been provided with a "built-in, contoured arch support" and/or with a sole having a contoured, so-called "orthopedic" upper surfaces, with extreme physical activity including sudden starts, stops and the concomitant constant flexing of the soft upper, the wearer's feet may tend to slide somewhat within the upper. Worse still, the ties or laces of the shoe may loosen or become undone causing the wearer to be endangered and threatening the loss of the shoe, itself.

In accordance with the present invention, athletic footwear is provided with a supporting integral cinch arrangement, the two components of which are firmly anchored at the sole between the sole and the upper in the vicinity of the arch. Thus, when the cinching strap is pulled upwardly and over the foot and is connected to the cinch anchor, it contributes to the support under the arch of the foot and firmly adheres the footwear to the foot. At the same time, because the cinch strap folds and closes over the underlying conventional primary closure, such as shoe laces, the fastened, tightened cinch has the effect of holding the conventional closure of the footwear in place in a "fail-safe" manner.

Thus, the footwear of the invention remains firmly in place on the foot of the wearer, and the laces or primary closure is safely secured with the bottom of the foot maintained firmly, solidly, and comfortably against the contour of the upper surface of the sole.

The use of "Velcro" components to form the cinch is particularly appropriate because hooked and looped fastening strips may be locked tightly together and peeled apart easily; furthermore, the mating surfaces of the hooked portion and the looped portion may be infinitely adjusted in relation to each other to provide varying degrees of tightness in adjusting the closure in accordance with the needs and desires of the wearer.

Other objects and advantages of the footwear of the invention will be apparent from the following detailed description in which athletic-type footwear is described, and from the accompanying drawings illustrating the various detailed aspects of the invention, with the particular illustrations depicting an open mesh upper on a generally solid wedge-type unit sole having an "orthopedic" contoured upper surface.

DETAILED DESCRIPTION OF A PREFERRED EMBODIMENT

Figure 1:
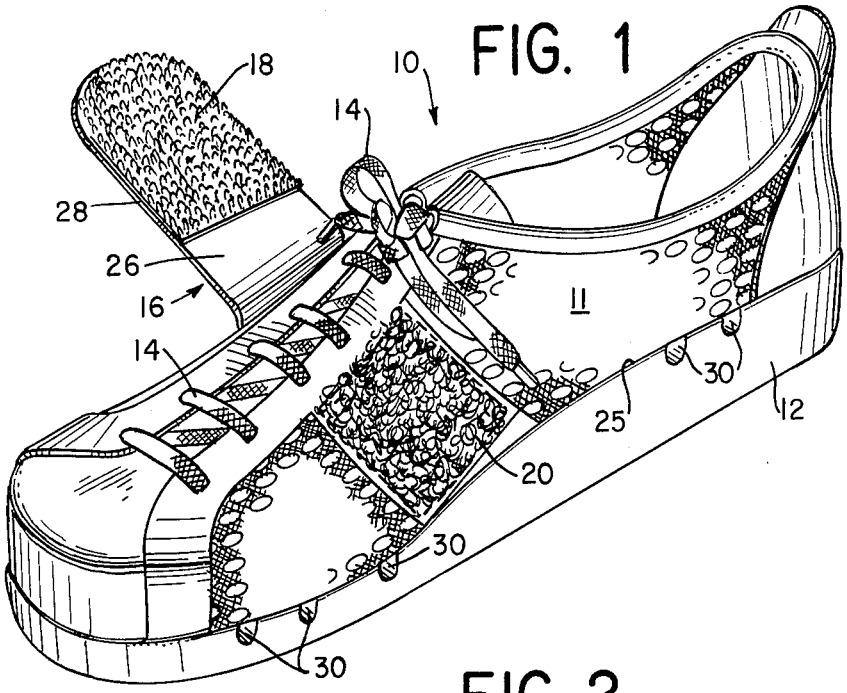
FIG. 1 is a perspective view of an athletic-type shoe embodying aspects of the invention, with the cinch-type closure of the invention in an open position.

Referring to the drawings in which like reference characters refer to like parts throughout the several views thereof, FIG. 1 shows an athletic type shoe designated generally 10, with an open mesh upper 11 connected by adhesive and/or stitching or other suitable means to a solid wedge-shaped sole 12. As will be appreciated, the sole 12 may include internally formed passages to reduce the weight thereof, to increase the flexibility thereof, and to provide air circulation when ports 30 are included. Moreover, the upper surface 25 of sole 12 is advantageously contoured to provide "orthopedic" or anatomically conforming support for the foot. The internal passages (not shown) in sole 12 may extend to openings 30 at the edge of sole 12 in order to provide interior ventilation and cooling. In the form of invention shown in FIGS. 1–3, the shoe is closed or laced up by conventional shoe laces 14.

Figure 2:
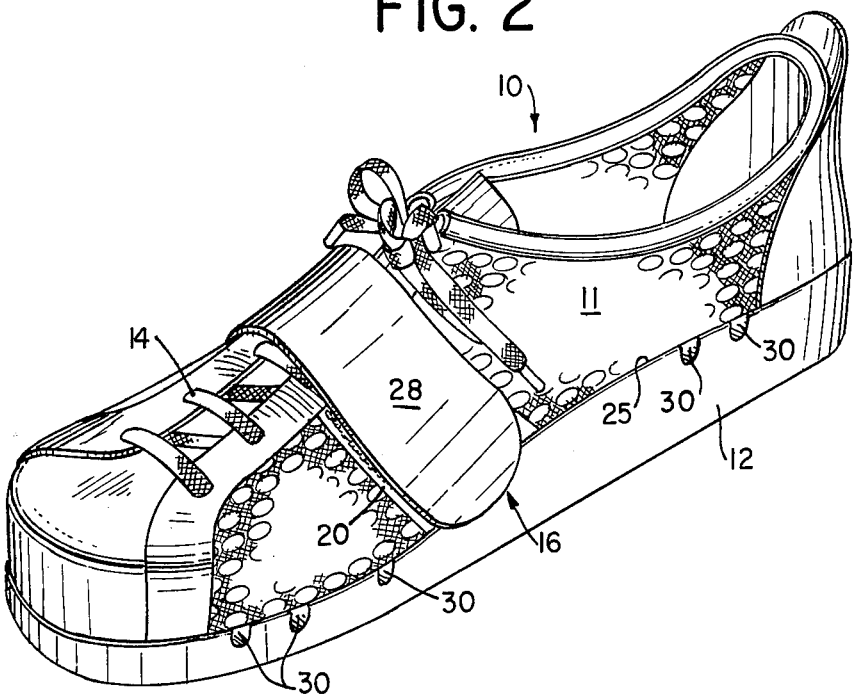
FIG. 2 is the same view as FIG. 1 with the cinch-type closure of the invention in a closed position.

As shown in FIG. 1, a cinching strap 16, integral with upper 11, is in open position with a hooked strap of "Velcro" tape 18 secured to the inner surface of the cinching strap 16, and a cooperating looped anchoring strip of "Velcro" tape 20 fixed on the opposite side surface of upper 11. As shown in FIG. 2, the cinching strap 16 is in a closed position with cooperating strips 18, 20 of the closure pressed into interlocked relation with each other. In this position, the cinching closure covers and maintains laces 14 in a tied, laced up condition.

Figure 3:
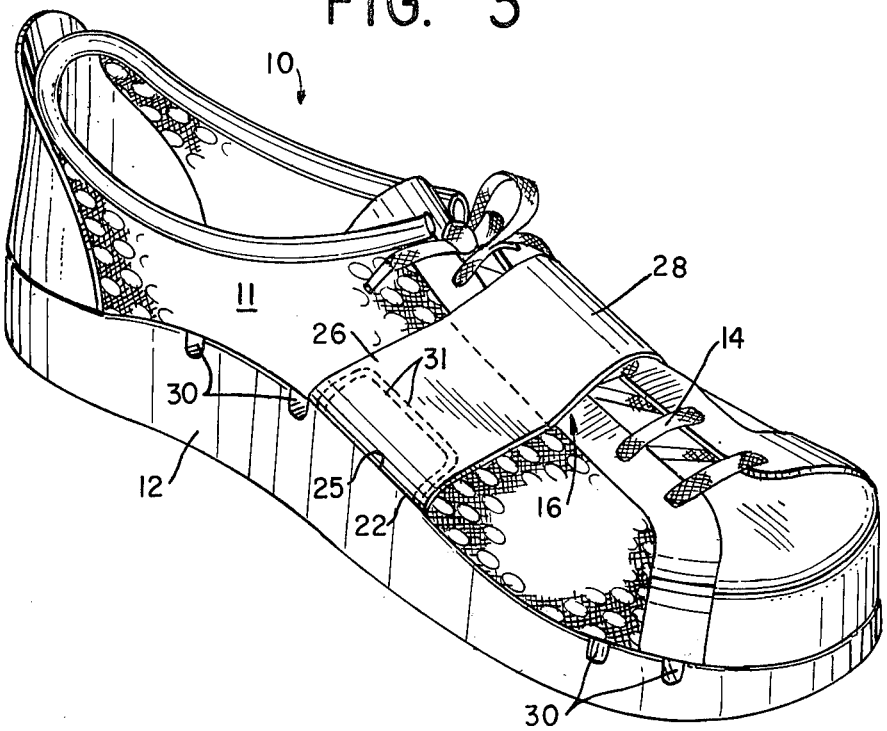
FIG. 3 is a perspective view of the shoe of FIG. 1 as viewed from the inner or arch side of the shoe.

Referring to FIG. 3, the cinching strap extends generally upwardly and outwardly from the interface 22 between the upper 11 and the sole 12. The lower portion 26 of the cinching strap 16 is fixed between the arch or inner side of the upper 11, and as such, extends under the arch of the wearer when the shoe is worn. The cinching strap may be reinforcedly, directly secured to the upper by a line or lines of stitching 31. Because of this, when the portion 28 of the cinching strap 16 is pulled over the top of the foot, the portion 26 is raised along with the underlying shoe upper itself to contribute to the support underneath the arch of the wearer. Such support, in combination with the orthopedically contoured, anatomically conforming upper surface of the sole provides a firm, comfortable and extensive overall arch support for the wearer.

Thus, as will be apparent from the foregoing, there is provided in accordance herewith a combination supporting and closing cinching arrangement for footwear, which serves simultaneously to maintain an adjustable closure for the footwear and to reinforce the support of the arch area.

While the athletic footwear herein disclosed forms a preferred embodiment of the invention, this invention is not limited to that specific footwear illustration, and changes may be made therein without departing from the scope of the invention which is defined in the appended claims.

I claim:

1. Athletic footwear with an improved closure, comprising (a) a unit bottom;

(b) an upper adhered to said unit bottom, said upper having a laceable closing portion;

(c) a closure cinching strap having one end connected to said upper and a first fastening tape means secured to its free end;

(d) said connected end of said cinching strap extending from instep portions of said upper;

(e) said cinching strap being sandwiched between said upper and said bottom in the area of the arch;

(f) said cinching strap being stitched directly to said upper adjacent the arch;

(g) anchoring fastening tape means on said upper at the side opposite to said connected end;

(h) said first fastening tape means and said anchoring fastening means being hooked and looped "Velcro"-type strips.

* * * * *